United States Patent [19]

Kitajima et al.

[11] Patent Number: 4,962,920

[45] Date of Patent: Oct. 16, 1990

[54] SHEET SORTING DEVICE

[75] Inventors: Tadayuki Kitajima, Yokohama; Toshiyuki Asakawa, Sagamihara; Masataka Naito, Yokohama; Kazuhiro Matsuo; Toshiaki Murayama, both of Tokyo, all of Japan

[73] Assignee: Canon Kabushiki Kaisha, Tokyo, Japan

[21] Appl. No.: 195,079

[22] Filed: May 17, 1988

Related U.S. Application Data

[62] Division of Ser. No. 838,826, Mar. 12, 1986, Pat. No. 4,854,571.

[51] Int. Cl.[5] ..... B65H 39/10

[52] U.S. Cl. ..... 271/293; 271/294

[58] Field of Search ..... 271/293, 294, 292

[56] References Cited

U.S. PATENT DOCUMENTS 4,337,936 7/1982 Lawrence ..... 271/293

4,580,775 4/1986 Maruyama ..... 271/294 X

FOREIGN PATENT DOCUMENTS 193858 11/1983 Japan ..... 271/293

23082 1/1986 Japan ..... 271/293

23083 1/1986 Japan ..... 271/293

*Primary Examiner*—Joseph J. Rolla

*Assistant Examiner*—David H. Bollinger

*Attorney, Agent, or Firm*—Fitzpatrick, Cella, Harper & Scinto

[57] ABSTRACT

A sheet sorting device having a plurality of bin trays has a resilient member for imparting to a bin tray support member a force in the direction opposite to the direction of gravity and reducing a load applied to a bin tray drive source. A detecting device for stopping the driving of the drive source detects the movement of the drive source when the drive source moves up or down relative to the bin trays. Drive source has two lead portions, smooths the movement of the bin group and makes the amount of opening between the bins always constant.

4 Claims, 11 Drawing Sheets

SHEET SORTING DEVICE

This is a division of application Ser. No. 838,826, filed Mar. 12, 1986, now U.S. Pat. No. 4,854,571.

BACKGROUND OF THE INVENTION

1. Field of the Invention

This invention relates to a sheet sorting device (hereinafter referred to as the sorter) used for distribution, accumulation, etc. of sheet-like members (hereinafter simply referred to as sheets) carried out from a machine such as a copying machine, a printing machine, a recording machine or other machine (hereinafter referred to as an image forming apparatus) provided with a mechanism for conveying sheet-like members (including various sheet-like members such as copy sheets, printing sheets and recording sheets).

2. Description of the Related Art

The device of this type (the details of which are described in Japanese Patent Application Laid-Open No. 78770/1981) has heretofore been of a construction as shown in FIG. 1 of the accompanying drawings wherein the rear ends 1 of bins 2 are held and only the fore ends of the bins are successively moved upwardly or downwardly by the engagement between engaging members 3 at the fore ends of the bins 2 and a Geneva stop 4 or a spiral cam comprising a single groove. In such a construction, if the angle of inclination of the bins with respect to the direction of sheet conveyance is $\alpha$, the angle $\alpha$ differs from bin to bin, and this has led to a disadvantage that the sheet supporting property differs between the bins.

As a method of the eliminating this disadvantage (that is, making the angle of inclination $\alpha$ of the bins constant), there is a method of vertically moving the bins as a unit and enlarging the spacing between the bins at the sheet carry-out port while successively moving the bins from one side to the other side. For example, as shown in FIG. 2 of the accompanying drawings, the spacing of engaging members 6*a*, 6*b*, provided on the bin 6, in the direction of movement (the spacing between 6*a*–9*a* and between 6*b*–9*b*) is controlled by support frame members 12 and 15, and an engaging member (not shown) provided on the rear end of the bin is also held by the support frame member 12 and therefore, a spiral cam comprising a spiral groove engages the engaging members (e.g. 6*a*, 6*b*) at the fore end of the bin, whereby the support frame member 12 itself is moved up and down and thus, the bin group is moved up and down as a unit. In such construction, the aforementioned disadvantage of the non-uniform supporting property of the bins is eliminated, but in the case of a high-speed sorter, when the bin tray group is to be moved upwardly or downwardly, a difficulty is caused when moving the bin tray group of heavy weight intermittently and rapidly, for example, the mechanical abrasion or damage by vibration, noise, shock, etc. Considering, for example, a case where all bins are being moved up in FIG. 2, the engaging members 9*a* and 9*b* of the bin 9 support all the load of the bin group, and the load of the bin group shifts to the engaging members 8*a* and 8*b* of the bins 8 when the bin 9 moves downwardly. Such shift of all the load takes place intermittently, whereby great noise or vibration occurs and expedites the mechanical abrasion, which in turn shortens the life of the device.

Further, as a method for eliminating such a disadvantage, there is known a method of dividing moving means for the bin group and means for enlarging the spacing between the bins at the sheet carry-out port and making them discrete from each other. For example, as shown in FIG. 3 of the accompanying drawings, a pin 21 for supporting the load of the bin group is provided on a bin frame 20 and this pin 21 is brought into engagement with a lead cam shaft 22 having the shape of a spiral groove to thereby effect continuous upward and downward movement of the bin group as a unit. Also, at the sheet carry-out port, for example, a bin 3, is moved to a position 23, by a spiral cam 24 comprising a groove to thereby enlarge the spacing between the bin $\mathbf{23}_1$ and $\mathbf{23}_2$. With such construction, the aforementioned disadvantage of the non-uniform sheet supporting property of the bins and the noise can be eliminated. However, again in this construction, the presence of the lead cam shaft 22 and the engaging pin 21 and the difference in shape between the grooves of the spiral cam 24 and the lead cam shaft cause a phase difference in the direction of height and therefore, a mechanism for alleviating this is necessary and moreover, two large extra lead cam shafts 22 become necessary, thus making the mechanism complicated and bulky, and also there are four locations of engagement with the lead cam shafts, which means a disadvantage that the assemblage and serviceability of the device are remarkably hampered.

Also, in a movable bin type bin shifting device, a chain or wire has been fixed to the ends of a bin unit comprising a plurality of bins and a bin support plate for supporting the bins and the chain or wire has been moved by a discrete driving device to move the bin unit up or down. As another method, a pin fixed to the ends of the bin unit has been operatively associated with a rotatable lead screw and the lead screw has been rotatable controlled to thereby moved the bin unit or down. Thus, in the former example, a brake device for moving the bin unit up or down to a predetermined place and fixing it at the predetermined place has been necessary, and in both of the former and latter examples, as sheets are supported on the bins, the entire bin unit becomes heavier and a driving device of large capacity has become necessary to cover it from first, and this has led to a disadvantage that the increased cost and bulkiness of the device are unavoidable.

Also, in this type of device, as a countermeasure for a case where the movement of the frame is blocked by the extraneous force of an obstruction or the like, a ratchet plate has been provided on a drive motor portion so that the destruction of the machine is avoided with the aid of the idle revolution of the motor, while this has led to complication and increased cost of the mechanism.

SUMMARY OF THE INVENTION

The present invention has been made in view of the above-noted disadvantages peculiar to the prior art and an object thereof is to provide a novel sheet sorting device.

Another object of the present invention is to provide a sheet sorting device in which upward and downward movement of a bin unit can be accomplished smoothly.

Still another object of the present invention is to provide a sheet sorting device in which the load of the bin unit during its upward and downward movement can be reduced.

That is, according to the construction of the present invention, at least two engaging portions are used for the movement of the bin group in the sheet sorting device, whereby different engaging portions can be used in accordance with the purpose of the movement of each bin to thereby smooth the movement of each bin.

More particularly, according to the construction of a sheet sorting device using a spiral cam member having a first spiral groove of uniform slope and a second groove of discontinuous groove shape having a pin stopping member, the entire bin unit can be moved by the smooth portion of an engaging portion and only the operation of opening the frontage of the bins can be effected by another engaging portion.

Also, the load of the bin unit can be offset by a simple construction in which a spring for reducing the bin shift force is mounted, and in spite of the sheet sorting device of the present invention being a movable bin unit type sorter, a lifter (motor) of only low capacity is required, and this is useful for energy saving. Also, structurally, the force applied to a lead cam may be small and thus, the fore end of the lead cam need be less reinforced. Particularly, in a preferred embodiment of the present invention, the upper end of the lead cam is reinforced by a metal member (because all the weight of supported sheets is temporarily applied thereto), while the lower end of the lead cam should only take the weight of a bin into account and therefore need not be reinforced. Also, the load of the bin unit can be offset, whereby the load fluctuating during the upward and downward movement of the bin unit is only the weight of the supported sheets thereon and the acceleration or the like during the upward and downward movement can be minimized and a silencing effect can also be obtained.

Further, by improving the shape of the lead cam, the distance between the uppermost trunnion and the lowermost trunnion is always kept constant and therefore, the lowermost trunnion can always be opposed to the lower surface of the lead cam. As a result, a spring for urging the trunnion against the lower surface of the lead cam becomes unnecessary.

DESCRIPTION OF THE PREFERRED EMBODIMENTS

Some specific embodiments of the present invention will hereinafter be described in detail with reference to the drawings.

Figure 1:
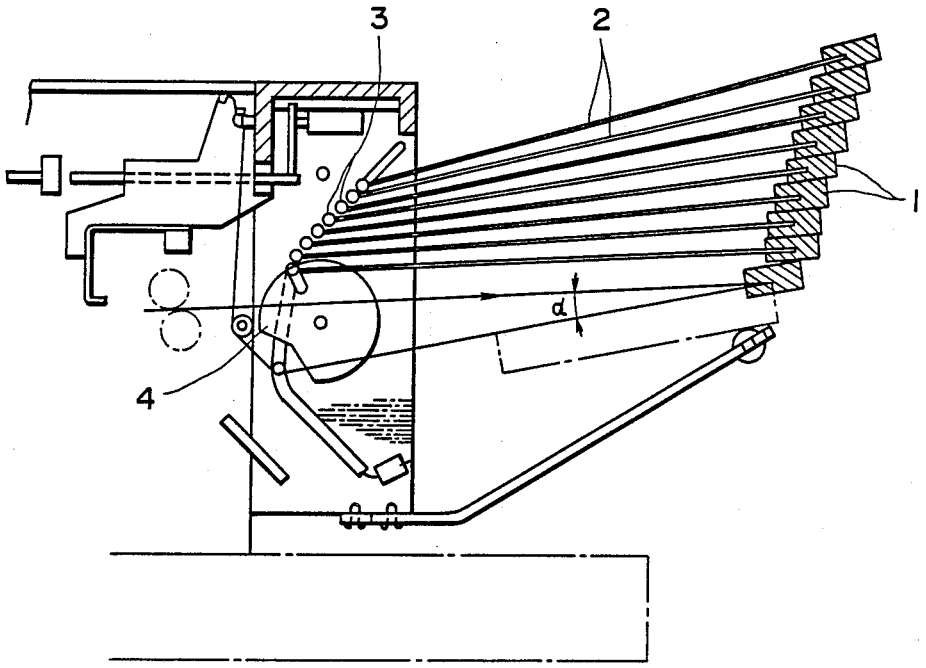
FIG. 1 PRIOR ART
FIGS. 1 to 3 are cross-sectional views showing some examples of the prior art.
Figure 2:
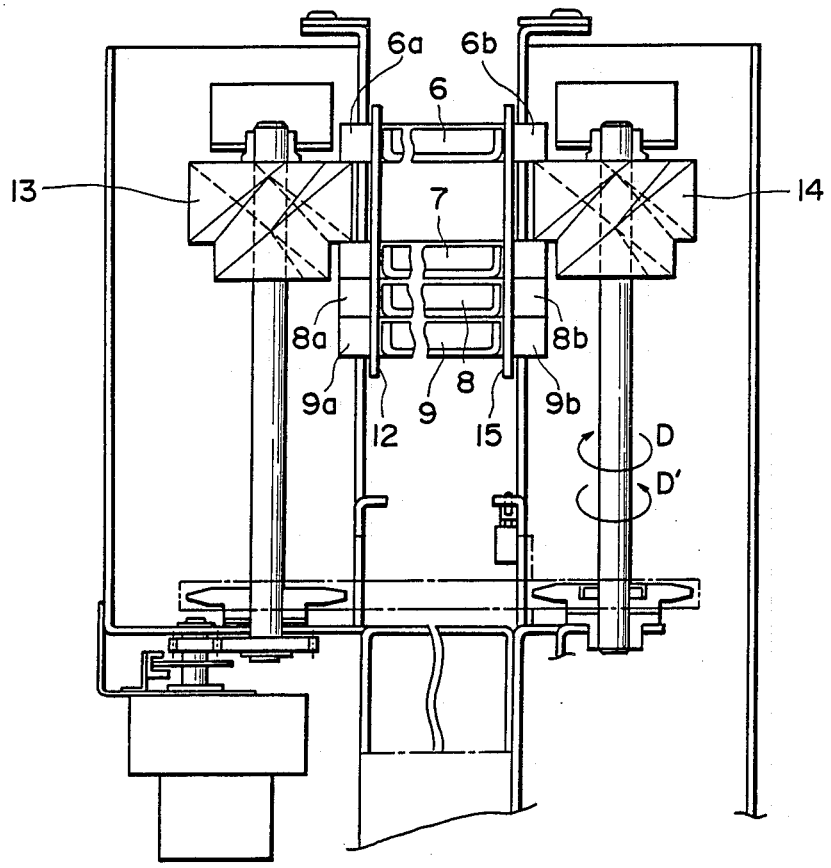
FIG. 2 PRIOR ART
Figure 3:
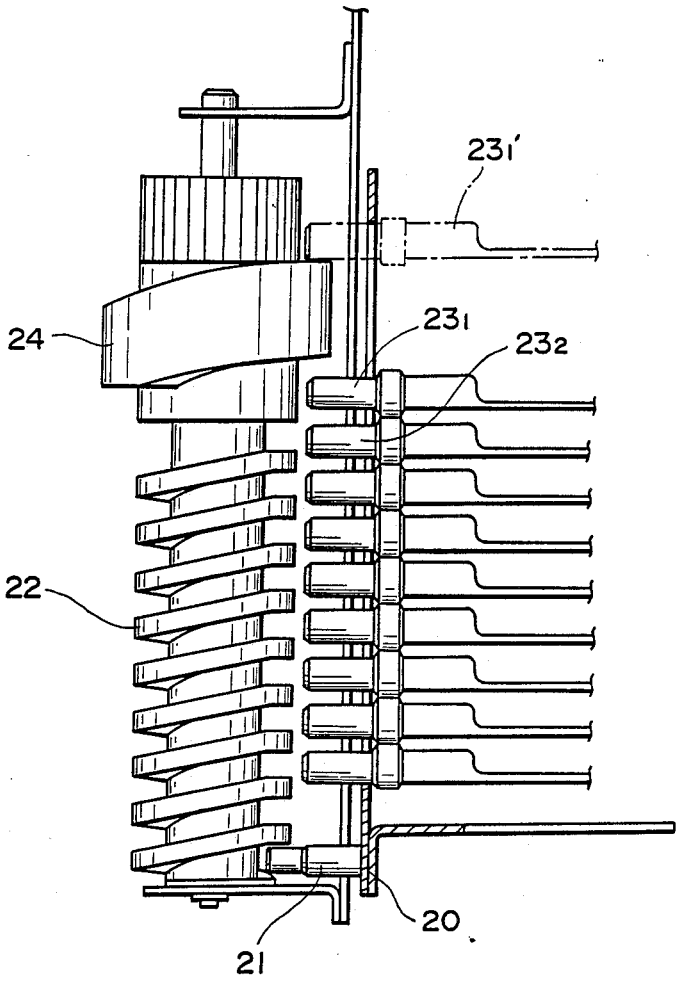
FIG. 3 PRIOR ART
Figure 4:
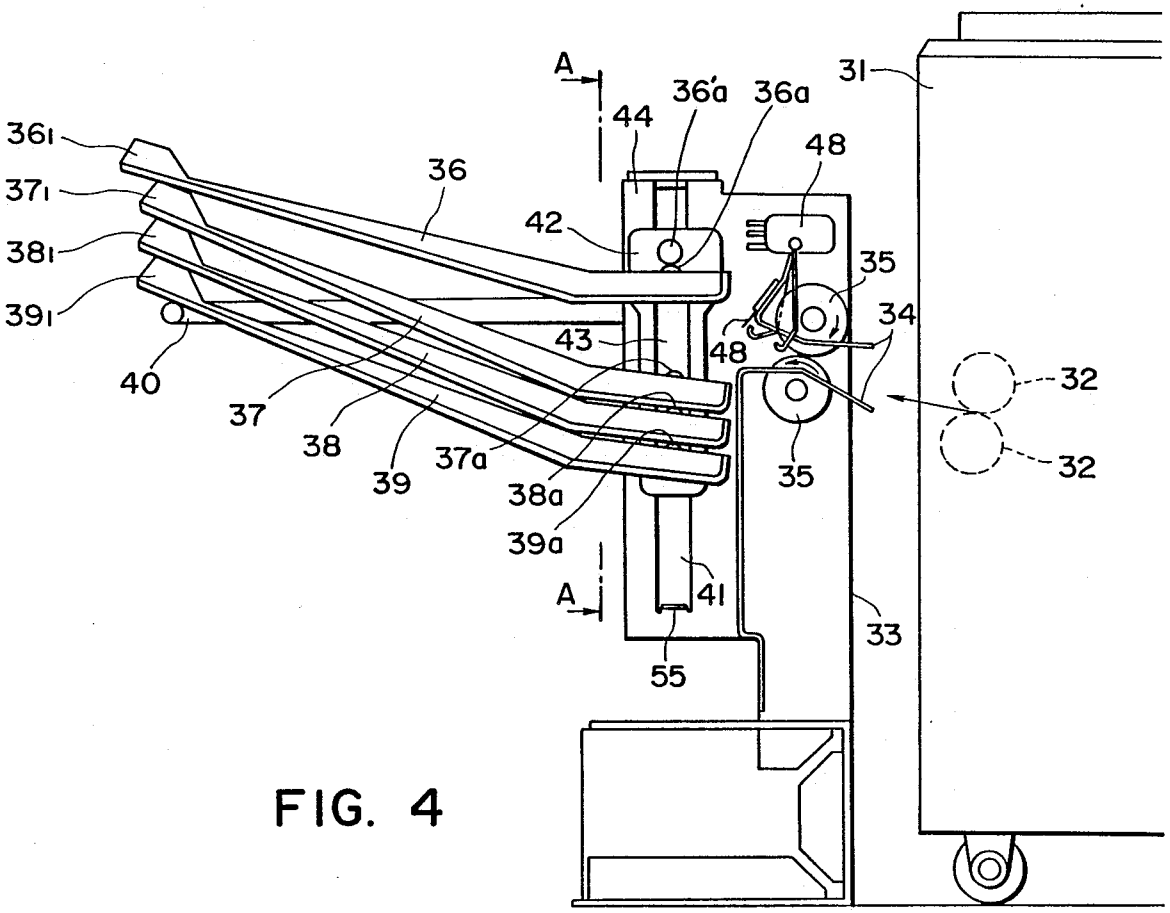
FIG. 4 is a side cross-sectional view of a sheet sorting device according to an embodiment of the present invention.

FIG. 4 is a side cross-sectional view of a sheet sorter according to an embodiment of the present invention. Sheets continuously discharged from a pair of paper discharge rollers 32 of a copying apparatus 31 are fed and received into bins 36–39 by a pair of conveyor rollers 35 through the inlet guide plate 34 of the sheet sorter 33 disposed in opposed relationship with the pair of paper discharge rollers 32. The pair of conveyor rollers 35 are rotated by a drive motor (not shown) when the bins are stopped with the space therebetween enlarged. The rear ends $36_1$, $37_1$, $38_1$, and $39_1$ of the piled-up bins 36–39 are supported by the support arm 40 of the sheet sorter body 33 and are slidably piled up.

Figure 6:
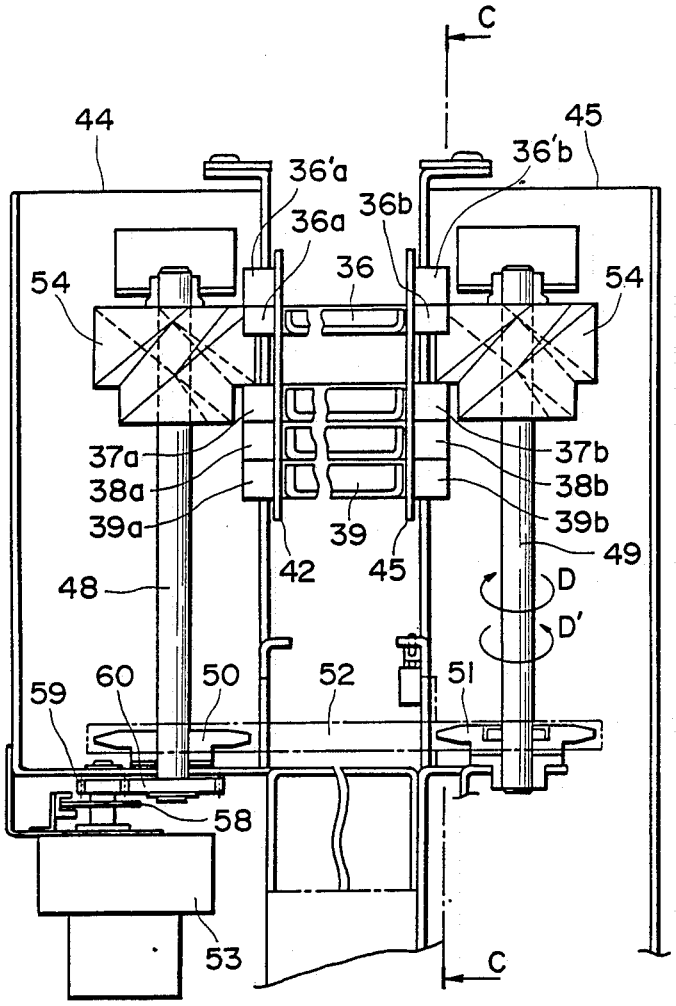
FIG. 6 is a cross-sectional view taken along line A—A of FIG. 4.

The left and right struts 44 and 45 of the sorter body 33 are disposed on the sheet receiving side of the sheet sorter (FIG. 6), and a vertically extending slot 41 is formed in the side wall of each strut. Pillar-like followers **36*a*, 36*b*, 37*a*, 37*b*, 38*a*, 38*b*, 39*a* and 39*b* provided on the left and right side surfaces of the fore ends of the bins are slidably engaged with the slots 41 (FIG. 6). The followers 36*a*, 36*b*, 37*a*, 37*b*, 38*a*, 38*b*, 39*a* and 39*b* are also engaged with support frames 42**.

Figure 5:
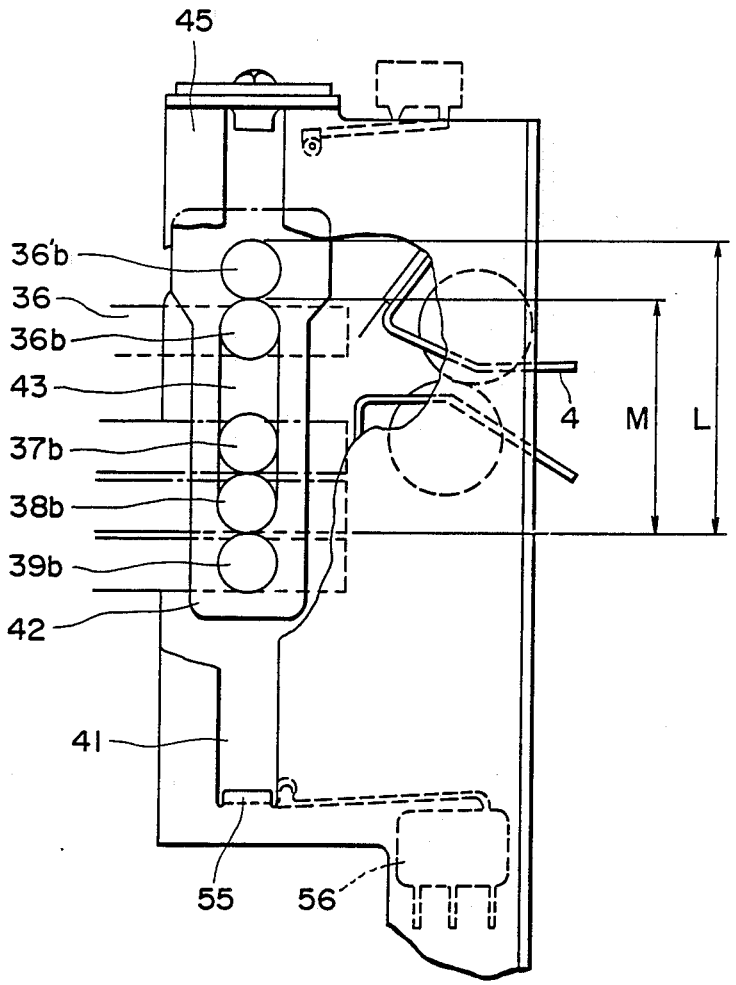
FIG. 5 is a partly broken-away cross-sectional view taken along line C—C of FIG. 6 and showing the engagement between a support frame and each follower.

FIG. 5 is a side view showing the state of engagement between one support frame 42 and each follower. A slot 43 like the slot 41 is formed in the support frame 42, and the support frame 42 is vertically slidable along the slot 41. A locating pin **36'*b* supporting the load of the bin group is engaged with the upper portion of the support frame 42 and accordingly, in the present embodiment, the support frame 42 is moved up and down by vertical movement of the locating pin 36'*b*. The followers 36*a*, 36*b*, 37*a*, 37*b*, 38*a*, 38*b* at the left and right of pins 36, 37, 38 are engaged for vertical movement in the slots 43 of the left and right support frame 42. In the present embodiment, the bin 39 is fixed to the support frames 42, but the left and right followers 39*a* and 39*b* of the bin 39 may be made vertically movable in the slots 43 of the left and right support frame 42**.

FIG. 6 is a cross-sectional view as seen from the rear ends of the bins and taken along line A—A of FIG. 4. A pair of grooved spiral cams 54 each formed with a first spiral groove 54' (FIGS. 7 and 8) having a uniform slope and a second spiral groove 54'' (FIGS. 7 and 8) for enlarging the space between the bins are provided on the left and right struts 44 and 45 and are fitted to and supported by the upper portions of vertical rotary shafts 48 and 49. Sprockets 50 and 51 are provided on the lower portions of the rotary shafts 48 and 49 and transmit the rotational force of a motor 53 to the pair of spiral cams 54 through a chain 52 and gears 59, 60. The motor 53 is revolvable in forward and reverse directions and in the ensuing description, the case where it rotates the rotary shaft 49 in a direction D (the case where the bins are moved up) is called the forward revolution.

Figure 7:
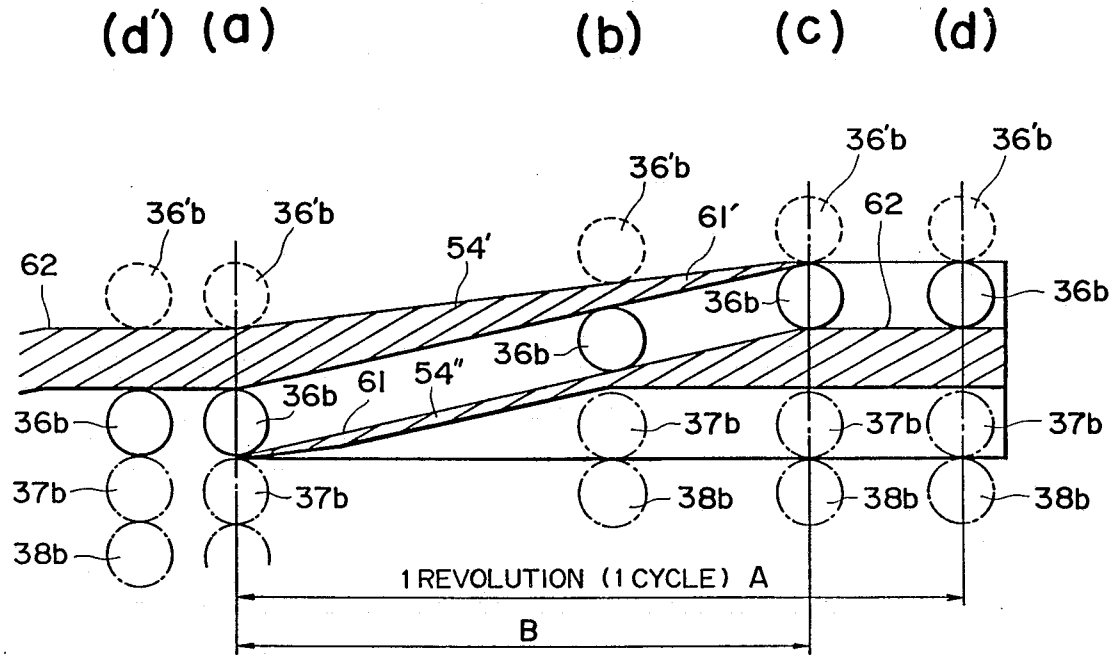
FIG. 7 is a developed view of the outer periphery of a spiral cam showing the engagement thereof with followers.
Figure 8:
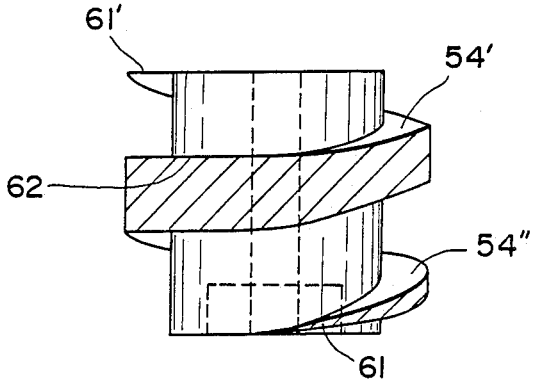
FIG. 8 is a detailed view of the spiral cam.

FIGS. 7 and 8 are developed views of the outer periphery of the spiral cam 54 according to the present invention. In FIG. 7, the stroke (d')-(d) is the locus of one revolution of the spiral cam 54. In the spiral cam 54 of the present embodiment, the pitch thereof is determined so that the followers **36*a*, 36*b*, 37*a*, 37*b*, 38*a*, 38*b***, 39*a* and 39*b* are taken up from the lower surface to the upper surface of the spiral cam by one revolution.

The sheet sorting operation will hereinafter be described in detail with reference to FIGS. 4 to 8. When the sheet sorter is started to operate by the input instructions from the copying apparatus 31, the motor 53 revolves in the reverse direction D' and the support frames 42 with the fore end of the bin group are moved down along the slots 41 (the state indicated at (d'in FIG. 7). In FIG. 7, the state indicated at (d) represents the positions of the respective followers of the bin group in FIG. 4. All the weights of the bins 36, 37, 38 and 39 act on the follower 36'*b* through the support frame 42.

Accordingly, when the spiral cam 54 makes one reverse revolution with the follower 36'*b* engaged with the first groove 54' of the spiral cam 54 and the follower 36*b* of the bin 36 engaged with the smooth surface 62 of the second groove 54" of the spiral cam 54 as shown in the state (d) the follower 36'*b* moves down to the position of the follower 36*b* of the bin 36 and the bin 36 moves down to the position of the bin 37 (indicated at (a)). The revolution is designed to be stopped by the smooth surface 62 (FIG. 8) of the second groove of the spiral cam 54, and in this portion, the follower 36*b* is stopped (the state indicated at (d')). The support frame 42 with the bin group moves down to the lower end 55 of the slot. The lowermost end of the support frame 42 touches a microswitch 56 (FIG. 5) disposed at the lower end of the slot 41 and a transmission type sensor detects that the spiral cam 54 has come to its regular stop position (indicated at the position (d') in FIG. 7, and it is from the position (a) that the microswitch 56 is touched), whereupon the reverse revolution D' is terminated. The gear 59 directly connected to the motor is formed with a number of teeth at ratio of 1:1 to the cam driving gear 60, and one revolution of the motor causes one revolution of the cam 54. A revolution detecting plate 58 has a portion of its circumference cut away, and produces a detection signal to stop the revolution of the motor when it arrives at the transmission type sensor 57. This operation is repeated each time the motor makes one revolution. The detailed operation will be described later, and the motor can repeat its intermittent drive for each one revolution in either direction on the basis of the signal of the transmission type sensor 57.

Simultaneously with the termination of the reverse revolution stroke, the pair of conveyor rollers 35 begin to rotate and feed the sheet fed from the pair of paper discharge rollers 32 into the bin 36. The passage of the sheet is detected by a microswitch 48 (FIG. 4) provided downstream of the pair of conveyor rollers 35. The static electricity of the sheet is removed by the sheet being brought into contact with a discharging brush 48'.

When the sheet passes the microswitch 48 and the absence of the sheet between the pair of conveyor rollers 35 is detected, the rotation of the conveyor rollers 35 is stopped and the at the same time, the motor 53 starts forward revolution D. The bin starting position in this case is (d') in FIG. 7. By one forward revolution D, the follower 36'*b* lying on the smooth surface 62 of the first groove of the spiral cam 54, with the support frame 42, is moved up along the spiral groove 54' having a uniform slope, and a taking-up portion 61 of an acute angle forming the lower end of the second spiral groove 54" of the spiral cam 54 comes into contact with the peripheral surface of the lower portion of the follower 36b and only the follower 36*b* is pushed up along the second spiral groove 54". The other bins 37, 38 and 39 are not guided by the second spiral groove 54" of the spiral cam 54, but are pulled up by the support frame 42 to a recess formed along the outer periphery of the bottom of the spiral cam 54. The follower 36*b* comes to the regular stop position (d) on the smooth surface 62 of the second groove of the spiral cam 54 and the forward revolution D is stopped. At this time, the follower 36'*b* already positioned on the smooth surface 62 of the second groove of the spiral cam 54 moves up along the first spiral groove 54', and then is placed on the follower 36*b*.

By this one revolution, the bin group is moved upwardly by an amount corresponding to the diameter of the follower and at the same time, the spacing between the bins 36 and 37 is enlarged. Simultaneously therewith, the pair of conveyor rollers 35 begin to rotate and feed the sheet into the bin 37. When the termination of the feed-in is detected by the microswitch 48, the rotation of the pair of conveyor rollers 35 is again stopped and the spiral cam 54 further makes one forward revolution D. At this time, the follower 37*b* is positioned in said recess and therefore, the taking-up portion 61 is reliably engaged therewith. Via the stroke (d'), (a), (b), (c), (d), the bin 38 is moved up to a position for receiving the sheet.

When the spiral cam 54 revolves (the number of bins−(1) times, the follower 39*b* of the lowermost bin 39 comes to the vicinity of the lower surface of the spiral cam 54. The follower 38*b* of the second bin 38 from below arrives at the piled-up position of the followers 36*b* and 37*b* of the bins 36 and 37 already supported on the smooth surface 62 of the second groove of the spiral cam. The pulse operation number of the transmission type sensor is counted to confirm that the lowermost bin 39 has arrived at the sheet receiving position, whereafter the pair of conveyor rollers 35 are rotated to feed the sheet into the bin 39.

As described above in detail, in the present embodiment, for example, in the cycle from the state (d') to the state (d) in FIG. 7, the weights of all the bins engaged by the support frame 42 are not exerted on the spiral groove 54", but up to the state (c) in which the follower 36*b* is in contact with the uppermost follower 36'*b*, the follower 36*b* of the single bin 36 should only be slid upwardly along the spiral groove 54". That is, unlike a device in which all the followers of the bins are engaged in the spiral groove, a number of followers are not slid in the spiral groove 54" and therefore, the drive force therefor may be small.

Next, in the downward movement stroke of the bins, the weights of the bins 36, 37, 38 and 39 act on the follower 36*b* of the bin 36 through the support frame 42 while it slides on the smooth surface 62 of the second groove. However, in a state in which a taking-up portion 61' of an acute angle forming the upper end of the first spiral groove 54' of the spiral cam 54 comes into contact with the peripheral surface of the upper portion of the follower 36*b*(*c*) and the follower 36*b* moves down in the second groove 54", the follower 36'*b* lying on the first spiral groove 54' supports all the load. A similar operation is repeated up to the state (d') of FIG. 7, and also in this state, the follower 36'*b* supports the load of the bin group. Thus, during the downward movement, the first spiral groove 54' and the smooth surface 62 of the second groove always support all the load.

Another embodiment will now be described.

Referring to FIGS. 9 to 14 which show another embodiment of the present invention, reference numeral 101 designates a sorter body, reference numeral 102 denote front and rear side plates constituting the sorter body, reference numeral 103 designates a guide rail provided on the front and rear side plates 102, and reference numeral 104 denotes a bin unit guided up and down on the guide rail 103. The bin unit 104 is constituted by members 105–117 which will hereinafter be described.

Reference numeral 105 designates a bin support plate formed of a frame structure, and reference numeral 106 denotes bin sliders mounted on the fore end of the bin support plate 105. Each of the bin slides 106 is provided with grooves 107 in the form of comb teeth. Reference numeral 108 designates a bin cover for fixing the front and rear bin sliders 106 and the bin support plate 105, and the front and rear frames of the bin support plate 105 are formed with slits 109 which are opposed to each other. Reference numeral 110 denotes bins for receiving sheets, and reference numeral 111 (FIG. 13) designates pins formed on the fore and rear ends of each bin 110. The bins 110 have their pins 111 inserted in said opposed slits 109, and the other ends of the bins are movably placed on the comb teeth-like grooves 107 of the bin sliders 106. A roller 113 is rotatably inserted over the pin 113 inserted in each slit 109, with an O-ring 112 of shock absorbing material interposed therebetween, thereby keeping the spacing between the bins equal to the diameter of the roller 113. Reference numeral 114 designates fixed shafts fixed to the bin support plate 105 near the lower ends of the slits 109, reference numeral 115 denotes fixed shafts vertically adjustably fixed to the bin support plate 105 near the upper ends of the slits 109, reference numeral 116 designates guide rollers rotatably mounted on the fixed shafts 114 and 115, and reference numeral 117 denotes a spring hooking metal member fixed to the bin support plate 105. The guide rollers 116 and rollers 113 are inserted in the guide rail 103, and the bin unit 104 is vertically movable along the guide rail 103 by the guide rollers 16 and rollers 113. Reference numeral 118 designates a spring secured to the side plate 102 and the metal member 117. The spring 118 serves to pull up the bin unit 104 along the guide rail 103. The spring 118 has a small spring constant and is designed such that the variation in its load relative to the amount of flexure is reduced and its load is substantially balanced with the load of the bin unit 104 when the bin unit 104 is in its uppermost position, and its load becomes somewhat stronger when the bin unit 104 is in its lowermost position.

A cam shaft holder 119 (FIG. 12) is fixed to the front and rear side plates 102, and lead cam shafts 122 are rotatably provided on a base 120 which, together with the side plates 102, constitutes the sorter body 101, through bearings 121. Reference numeral 123 designates a lead cam, and reference numeral 124 denotes a sprocket fixed to each lead cam shaft 122. Reference numeral 125 designates a shift motor capable of forward and reverse revolutions, and reference numeral 126 denotes a chain connecting the sprocket 124 and the shift motor 125 together and designed to transmit the drive force of the shift motor 125 and be able to revolve the lead cam 123 in forward and reverse directions.

The spacing between the guide rollers 116 at the upper and lower ends of the bin unit 104 is controlled by the diameter of the rollers 113 (i.e., the spacing between the bins) and the lead width of the lead cam 123 supporting the rollers 113 thereon, and actually is regulated and fixed with an allowance of 0.4–0.5 mm.

The rollers 113 ride on the cam surface of the lead cam 123 and, by the lead cam 123 revolving in forward and reverse directions, the rollers 113 may be vertically moved along the cam surface and the rollers 113 may be moved upwardly by an amount corresponding to the lead width of the lead cam 123 in a clockwise direction as viewed from above.

The lead cam 123 is located near the paper outlet of the sorter 101 and is designed to widen the inter-bin spacing at the outlet more than the other inter-bin spacing by an amount corresponding to the lead width. The lead cam 123 is controlled by other signal so as to be capable of continuous forward and reverse revolution and stopping or one forward and reverse revolution and stopping.

Operation of the sorter having the above-described construction will now be described. The bin unit 104 is normally positioned and stopped at the lower end of the sorter. The uppermost guide roller 116 rests on the lead cam 123 and is supported and stopped by the rollers 113 and the lowermost guide roller 116 without any gap therebetween (actually with an allowance of 0.4–0.5 mm). The load of the bin unit 104 is offset by the spring 118, and little or no load is applied to the lead cam 123 in spite of the guide roller 116 resting thereon. The shift motor 125 is revolved by a shift signal to cause the lead cam shaft 122 and the lead cam 123 to make one revolution in a clockwise direction through the chain 126 and the sprocket 124 and then stop. At that time, the roller mounted on the uppermost bin moves up by an amount corresponding to the lead width while rolling on the surface of the lead cam and at the same time, it pushes up the guide roller 116 resting on the lead cam 123 along the guide rail 103 and comes to lie on the lead cam 123. Accordingly, the bin unit 104 moves up by an amount corresponding to the diameter of the roller 113. Thus, the uppermost bin has its fore end slid by the bin slider 106 and its other end (which is adjacent to the rollers) moved up by an amount corresponding to the lead width, thus opening the discharge port. The lead cam 123 repeats revolution and stoppage by a signal, whereby the bin unit 104 is moved up while opening the discharge port, but since the load is offset by the spring 118, little or no thrust load is applied to the lead cam 123 and the lead cam shaft 122. Subsequently, the shift motor 125 is revolved in the reverse direction by a signal, whereupon the lead cam shaft 122 and the lead cam 123 make one revolution in a counter-clockwise direction and then stop. At that time, the lead cam 123 causes the roller resting thereon to move down along the cam surface by an amount corresponding to the lead width. Thus, the next upper roller rides onto the lead cam and the bin unit 104 moves down by an amount corresponding to the diameter of the roller 113. Thus, the fore end of the bin supported by the roller moved down by an amount corresponding to the lead width slides in the groove 107 of the bin slider 106 while the other end thereof (which is adjacent to the roller) moves down by an amount corresponding to the lead width as compared with the other bins, thus widening the frontage of the sheet discharge port. The bin unit 104 is moved down successively by a signal, but since the load is offset by the spring 118, no thrust load is applied to the lead cam shaft 122 and the lead cam 123 as in the case of the upward movement of the bin unit.

Actually, in the sorting mode, the bin unit 104 moves up while sheets are placed onto the successive bins from the uppermost one by a sheet discharge signal. Subsequently, in the reverse sorting mode, the bin unit 104 moves down while sheets are placed onto the successive bins by a sheet discharge signal.

Such operation is repeated, and the load applied to the lead cam shaft 122 and lead cam 123 is only equal to the weight of the sheets placed on the bins.

In the above-described embodiment, the tension spring 118 is directly secured to the metal member 117 of the bin support plate 105 and the side plate 102 of the sorter body 101, but alternatively, the bin support plate 105 may be suspended by a wire or the like and a torsion coil spring or a helical spring may be caused to act on the other end of the wire, thereby achieving effective utilization of the space.

Also, in the movable bin type sorter according to the present embodiment of the present invention, when the bin moving portion is held by an extraneous force during its downward (or upward) movement, the movement can be stopped by a safety device utilizing the extraneous force. This safety device will hereinafter be described.

Figure 12:
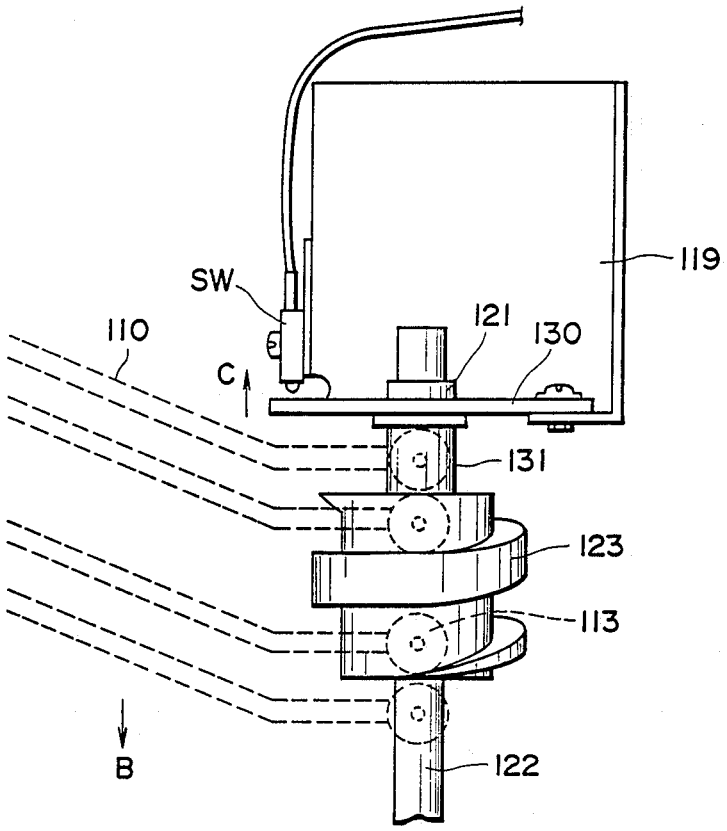
FIG. 12 is a detailed view of a lead cam portion.
Figure 13:
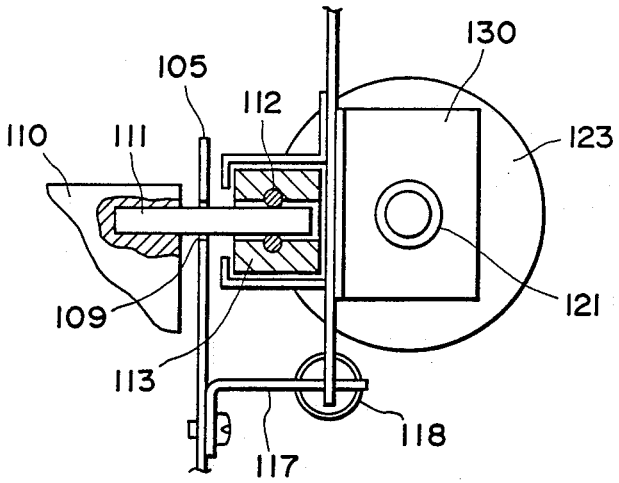
FIG. 13 is a top plan view of portions of the lead cam.

FIG. 12 is a detailed view of the lead cam shaft portion. The lead cam shaft 122 and the lead cam 123 are supported by a cam shaft holder 119.

There is a plate spring portion 130 in the cam shaft holder 119, and a bearing 121 is in engagement therewith.

Figure 9:
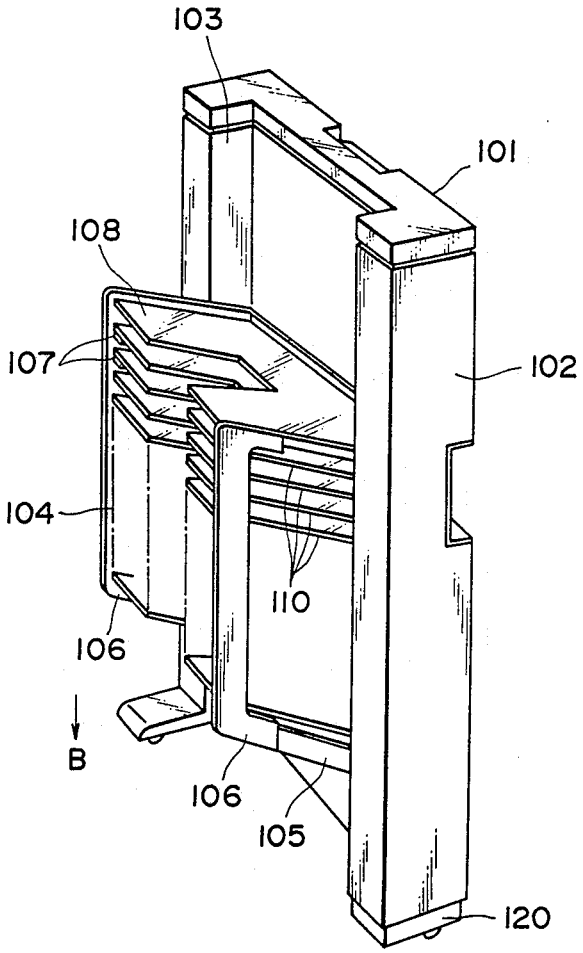
FIG. 9 is a perspective view of a sorter according to another embodiment of the present invention.
Figure 11:
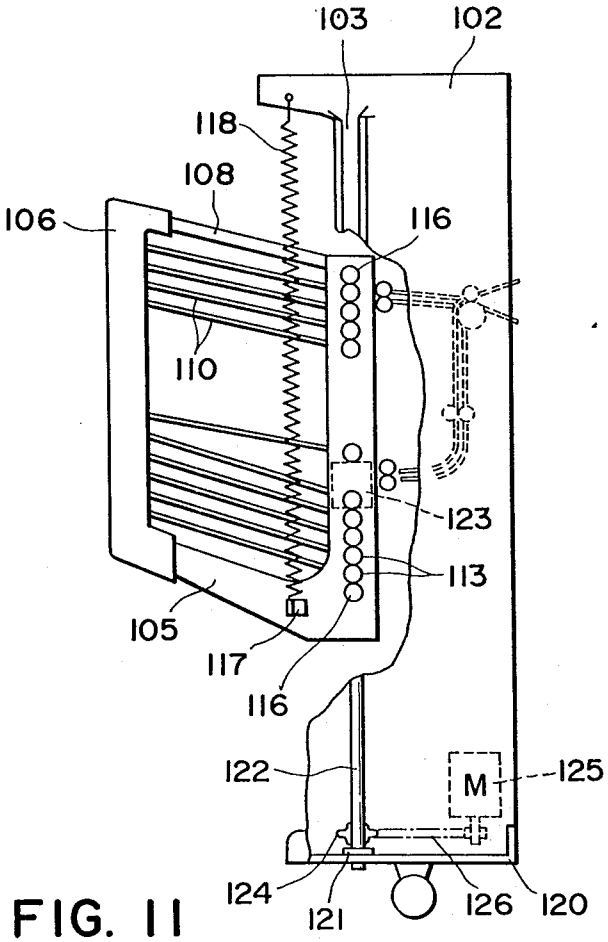
FIG. 11 is a cross-sectional view of portions of the sorter.
Figure 10:
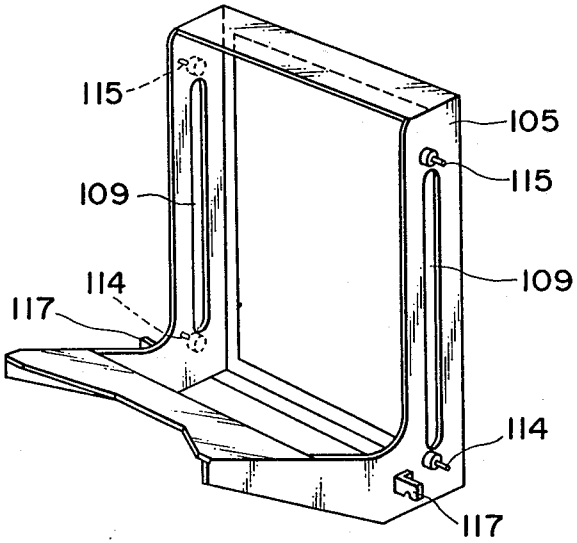
FIG. 10 is a perspective view of a bin support plate.

In FIG. 9, when during the movement of the bin frame 105 in the direction B, there is present an obstruction or the like below the bin frame and the movement is hindered thereby, the various portions of FIG. 12 operate in the following manner.

The force imparted from the obstruction is transmitted to the lead cam 123 from the bin frame 105→the bins 110→the cam followers 113 and moves the lead cam 123 upwardly. That is, the lead cam 123 is moved upwardly by the downward movement of the cam followers 113 being inhibited. This force is transmitted to the plate spring portion 130 through a spacer 131 and the bearing 121 to displace the fore end of the plate spring portion 130 (in the direction of arrow C). By the amount of this displacement, a limit switch SW held on the cam shaft holder 119 is operated to stop the motor 125. Upon stoppage of the motor 125, the bin frame 105 of FIG. 9 stops its movement in the direction B, thereby preventing the destruction of the machine.

As an alternative embodiment, detection of the displacement may be effected by a photosensor instead of the limit switch SW, and the present embodiment adopts the means for detecting the amount of displacement of the plate spring 130 of the cam shaft holder 119, but instead may adopt means for directly detecting the amount of upward movement of the lead cam. Also, if the limit switch SW is provided below the plate spring, any abnormality during the upward movement may be detected.

As described above, during the downward or upward movement of the bin moving portion of the movable bin type sorter, the extraneous force which hinders it can be utilized to prevent the destruction of the machine by a simple construction.

Figure 14:
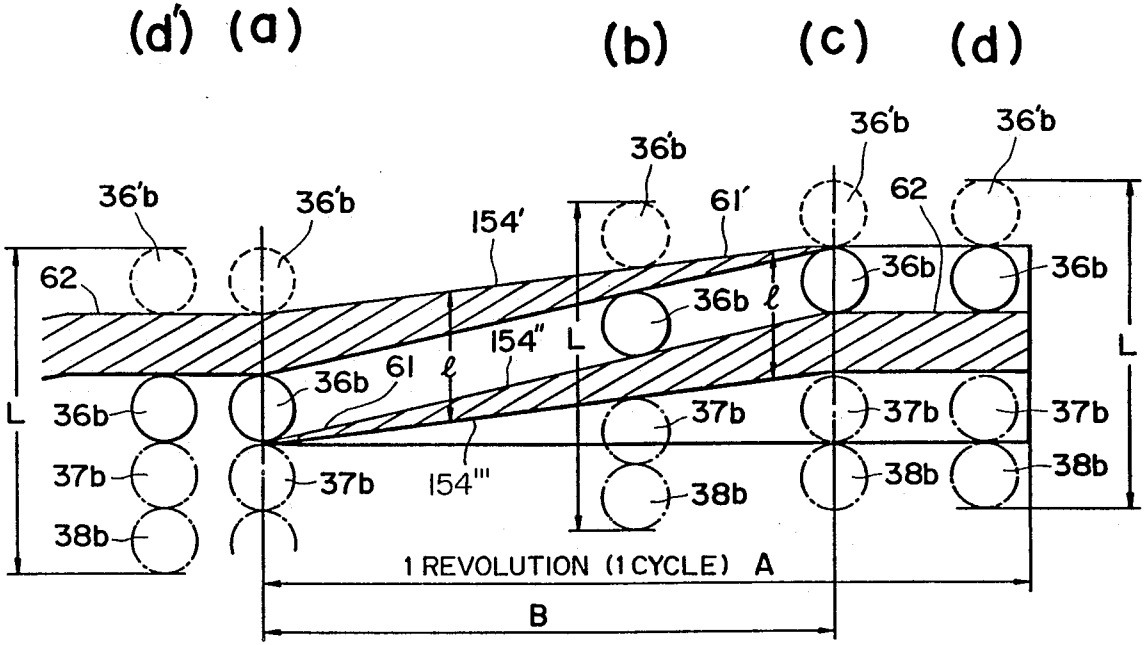
FIG. 14 is a developed view of the outer periphery of a modification of the FIG. 7 arrangement showing the engagement between a spiral cam and followers.

Reference is now had to FIG. 14 to describe a modification of the lead cam 54 shown in FIG. 7.

A feature of the lead cam 154 shown in FIG. 14 is that the cross-sectional shapes of the first groove 154' and the second groove 154'' are identical in the opposite direction and the height l of the cam measured when cut at any position in a vertical direction is constant.

In the other points, the construction shown in FIG. 14 is the same as the construction shown in FIG. 7. Again in the construction of FIG. 14, when the cam 154 rotates, the followers **36*a*, 36*b*, 37*a*, 37*b*, 38*a*, 38*b*, 39*a*, 39*b* move up and down. The details of it shown in FIG. 7**.

According to the feature of the construction of FIG. 14, when the followers are moved along the lead by revolution of the cam, the distance L between the lowermost follower and the uppermost pin is always constant at any point of time, Accordingly, as shown in FIG. 5, the distance M between the lower end surface of the pin 36 and the lower end surface of the slot 43 can be made minimum and thus, there will occur no play when the followers are assembled therebetween.

As a result, when the followers are moved up by revolution of the cam and the support frame 42 is moved up through the pin **36'*b*, the follower 38*b* is pushed up by the lower end surface of the slot 43. Then, the follower lying just beneath the cam 154 is urged against or brought close to the lower end surface 154''' of the cam 154. Accordingly, even if the follower is not urged against the lower end surface of the cam 154 by spring means, the follower will smoothly come into engagement with the lead of the cam 154 by revolution of the cam 154** and move up.

According to the above-described feature of the cam, the follower is not urged by the spring and therefore, the engagement between the cam and the follower is accomplished smoothly and the shock is small and thus, noise or the like does not occur. Also, since the load is light, the electric power consumed is small. Further, since the engagement between the follower and the lower end surface of the cam takes place continuously, there will not happen the accident that the follower collides against the lower end surface of the cam. That is, if said distance M is made a little greater and a play is provided and spring pressure is not applied to the follower, the lower end surface of the cam and the follower will be spaced apart from each other by an amount corresponding to this play at a certain point of time, whereafter the follower will suddenly bear against the lower end surface of the cam, thereby producing a sound. According to the present embodiment, there is no such play and therefore such a sound is never produced.

We claim:

1. A sheet sorting device having:

a plurality of bin trays provided separately in a vertical direction;

support means for vertically movably supporting said bin trays;

revolution means for moving said bin trays vertically by revolution thereof, said revolution means being vertically movable relative to said bin trays when the vertical movement of said bin trays is prevented;

motor means for revolving said revolution means; and detecting means for detecting the vertical movement of said revolution means when said revolution means moves vertically relative to said bin trays and stopping the revolution of said revolution means by controlling said motor means;

wherein said revolution means comprises cam means having a spiral groove, and a follower engaging said spiral groove is provided at the fore end of each of said bin trays and said spiral cam means is secured to a vertically movably supported shaft and moves vertically when upward or downward movement of said follower is impossible during the revolution of said spiral cam means.

2. A sheet sorting device according to claim 1, wherein said support means is generally movable vertically with said bin trays by said revolution means.

3. A sheet sorting device according to claim 1, wherein said shaft is supported on a body of said device by a resilient member.

4. A sheet sorting device according to claim 1, wherein said detecting means is switch means.

* * * * *

UNITED STATES PATENT AND TRADEMARK OFFICE

CERTIFICATE OF CORRECTION

PATENT NO. : 4,962,920

DATED : October 16, 1990

INVENTOR(S) : Kitajima, et al

It is certified that error appears in the above-identified patent and that said Letters Patent is hereby corrected as shown below:

Title page item [75] delete the inventor

--Tadayuki Kitajima--

COLUMN 6,
line 44, "be slid" should read --slide--.

COLUMN 7,
line 39, "guide rollers 16" should read --guide rollers 116--.

COLUMN 9,
line 62, "had" should read --made--.

COLUMN 10,
line 11, "time," should read --time.--.

Signed and Sealed this

Seventh Day of May, 1991

*Attest:*

HARRY F. MANBECK, JR.

*Attesting Officer*

*Commissioner of Patents and Trademarks*